US005634640A

United States Patent [19]

McCarrel

[11] Patent Number: 5,634,640

[45] Date of Patent: Jun. 3, 1997

[54] SPORTS TARGET SYSTEM

[76] Inventor: Daryel A. McCarrel, 4940 Iroquois Trail Dr., North Street, Mich. 48049

[21] Appl. No.: 354,376

[22] Filed: Dec. 12, 1994

[51] Int. Cl.[6] ..... A63B 63/04

[52] U.S. Cl. ..... 473/446; 273/406; 273/127 B; 473/197

[58] Field of Search ..... 273/1, 5 A, 411, 273/407, 402, 26 A, 400, 127 D, 398, 399, 127 R, 127 B, 391, 392, 406; 116/173, 174; 473/197

[56] References Cited

U.S. PATENT DOCUMENTS

| | | | |
|---|---|---|---|
| 2,587,042 | 2/1952 | Haiselap | 273/391 |
| 3,082,005 | 3/1963 | Kron | 273/392 |
| 3,328,033 | 6/1967 | Hendry . | |
| 3,678,886 | 7/1972 | Tibbet | 116/173 |
| 3,794,318 | 2/1974 | Holmes . | |
| 3,840,228 | 10/1974 | Greaney . | |
| 3,856,298 | 12/1974 | Frantti . | |
| 3,944,223 | 3/1976 | Bromwell . | |
| 4,189,146 | 2/1980 | Warner | 273/407 |
| 4,210,326 | 7/1980 | Booth et al. . | |
| 4,245,843 | 1/1981 | Griggs | 273/411 |
| 4,813,369 | 3/1989 | Moreland | 116/173 |
| 4,842,283 | 6/1989 | LeBel et al. . | |
| 4,915,381 | 4/1990 | Hackett | 273/1.5 A |
| 5,181,725 | 1/1993 | Leras et al. | 273/402 |
| 5,246,229 | 9/1993 | Carey . | |
| 5,348,291 | 9/1994 | Scully | 273/26 A |

FOREIGN PATENT DOCUMENTS 1206496 6/1986 Canada .

OTHER PUBLICATIONS

Stretch Cord Tie Down Product of USA Products, Lodi, CA date unknown, but at least as early as Dec. 11, 1993 it is believed.

Hockey Target Product of Promosports, Ltd, Canada date unknown manufacture under Can Pat 1070346 date at least as early as Dec. 11 1993 it is believed.

*Primary Examiner*—Mark S. Graham
*Attorney, Agent, or Firm*—Peter D. Keefe

[57] ABSTRACT

A sports target system adapted for use in connection with a backdrop, is generally composed of at least one resiliently stretchable cord having hooks at each end thereof, such as a conventional stretch cord, and at least one flaccidly flexible target, such as a cloth material having a predetermined color and/or indicia thereupon. The target is provided with a loop for receiving slidably therein the resiliently stretchable cord. In operation, the user places one or more targets onto the resiliently stretchable cord by passage of the resiliently stretchable cord through the loop of each of the targets. The hooks at each end of the resiliently stretchable cord are then hookably engaged with the left and right sides of the backdrop, such as the frame of a hockey goal. The one or more targets which hang downwardly from the resiliently stretchable cord, are now slid into a selected target practice position. A selectively removable target may be provided having a loop which is selectively openable and closable, such as by a hook and loop fastener, so that the removable target may be added or removed even while the resiliently stretchable cord is strung across the backdrop.

10 Claims, 1 Drawing Sheet

SPORTS TARGET SYSTEM

BACKGROUND OF TEE INVENTION

1. Field of the invention

The present invention relates to sports targets, and more particularly to sports targets used for hockey practice. Still more particularly, the present invention relates to a sports target which is easily installed and is both effective and durable.

2. Description of the Prior Art

A number of sports require the player to be proficient at directing a sports object, such as a baseball, a golf ball, or a hockey puck, to a predetermined location having extreme relevance to scoring in that particular sport, With respect to hockey as a preferred example, a backdrop serving as a goal is set-up on opposite ends of a play area. Each goal has a frame and a net strung thereupon, wherein a concave opening of the goal provides a target for the players of a first team to try to place a puck thereinto for the purpose of scoring. A goalie of a second team stands in front of the goal, and as best as he can, he attempts to foil the attempts of the first team from placing the puck into the goal behind him. Accordingly, in order that players of hockey become proficient at being able to place the puck into the goal, the players engage in practice sessions using their hockey sticks to place pucks at locations relative to the goal which are least likely to be adequately obstructed by a goalie during an actual game.

In the prior art there have been various attempts at providing sports targets, the aim of which being to assist perfection of the players' ability to direct a sports object to predesignated areas. U.S. Pat. No. 4,210,326 discloses a baseball pitching target composed of a frame, a front apertured panel connected with the frame and a rear net also connected with the frame. U.S. Pat. No. 3,328,033 discloses a golf ball target composed of a frame supporting, via four cords or lines having hooks at each distal end, an apertured target member having a net; a backdrop is connected with the frame. U.S. Pat. Nos. 3,840,228, 3,856,298 and 5,246,229 describe panel silhouettes for being positioned in front of a hockey goal for simulating the opportune target openings as may be presented when a goalie is thereat. Finally, U.S. Pat. No. 3,794,318 and Canadian Patent 1,206,496 both describe electrically actuated active hockey targets.

What remains needed in the art is a sports target system which is very easy to install and maintain, is easy to use and is effective at improving the skill of players of a sport to which the sports target system is directed.

SUMMARY OF THE INVENTION

The present invention is a sports target system which is very easy to install and maintain, is easy to use and is effective at improving the skill of players of a sport to which the sports target system is directed.

The sports target system according to the present invention is adapted for use in connection with a backdrop, and is generally composed of at least one resiliently stretchable cord having hooks at each end thereof, such as a stretch cord, and at least one flaccidly flexible target, such as a cloth material having a predetermined color and/or indicia thereupon. The target is provided with a loop for receiving slidably therein the resiliently stretchable cord.

In operation, the user places one or more targets onto the resiliently stretchable cord by passage of the resiliently stretchable cord through the loop of each of the targets. The hooks at each end of the resiliently stretchable cord are then hookably engaged with the left and right sides of the backdrop, such as the frame of a hockey goal. The one or more targets which hang downwardly from the resiliently stretchable cord, are now slid into a selected target practice position.

A selectively removable target may be provided having a loop which is selectively openable and closable, such as by a hook and loop fastener, so that the removable target may be added or removed even while the resiliently stretchable cord is strung across the backdrop.

Accordingly, it is an object of the present invention to provide a sports target system which is easily installed with respect to a frame, is easily adjustable, and is durable.

It is a further object of the present invention to provide a sports target system having a resiliently stretchable cord and one or more flaccidly flexible targets depending therefrom, wherein the one or more targets are each slidable along the resiliently stretchable cord to thereby provide adjustment of the target location.

It is another object of the present invention to provide a sports target system having a resiliently stretchable cord and one or more flaccidly flexible targets depending therefrom, wherein a target is selectively installable and removable from the resiliently stretchable cord to thereby provide adjustment of the number of the targets.

It is yet a further object of the present invention to provide a sports target system having a resiliently stretchable cord and one or more flaccidly flexible targets depending therefrom to thereby provide a portable sports target for simple and removable installation with any number of backdrops.

These, and additional objects, advantages, features and benefits of the present invention will become apparent from the following specification.

DETAILED DESCRIPTION OF TEE PREFERRED EMBODIMENT

Figure 1:
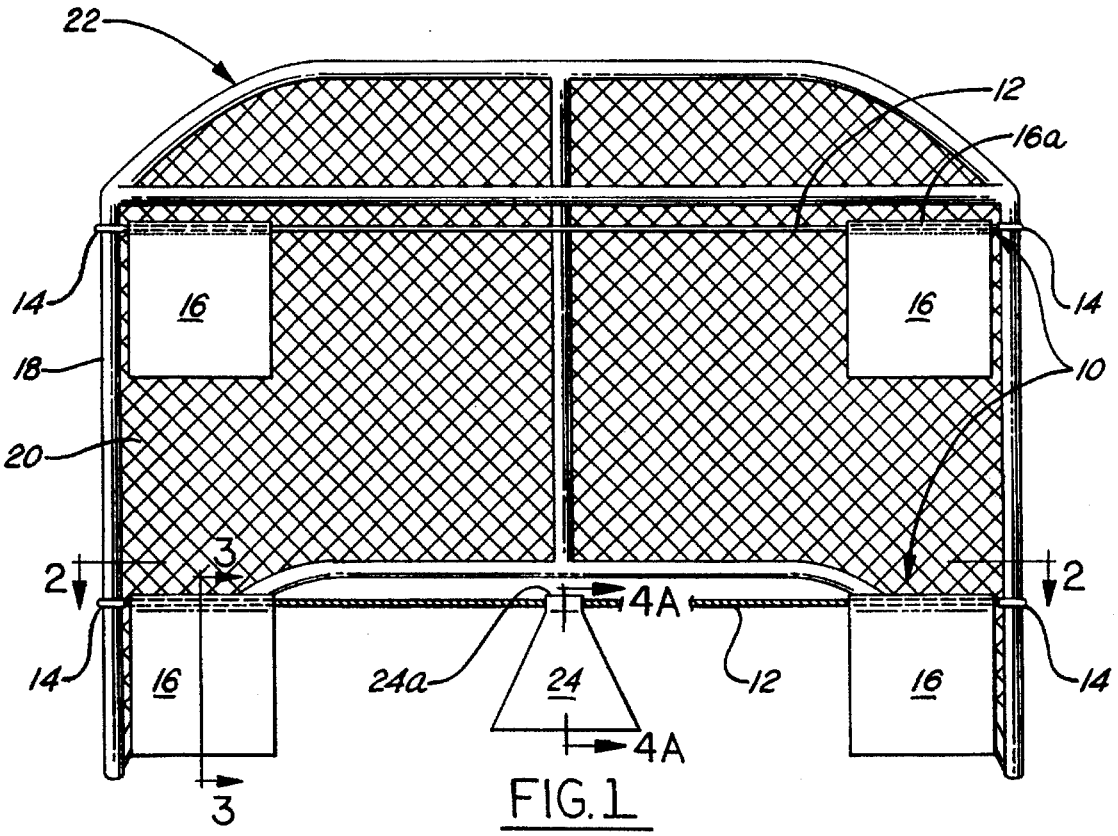
FIG. 1 is a front view of the sports target system according to the present invention, shown in operation with respect to a hockey goal.
Figure 2A:
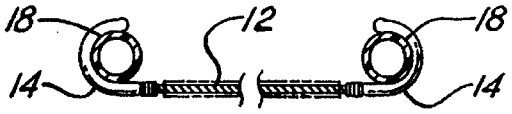
FIG. 2A is a partly sectional view along line 2—2 in FIG. 1.
Figure 3:
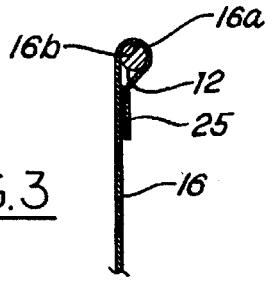
FIG. 3 is a sectional view along line 3—3 in FIG. 1.
Figure 2B:
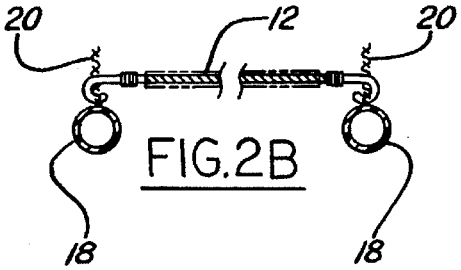
FIG. 2B is a partly sectional view similar to that of FIG. 2A, wherein an alternative hock engagement is depicted.

Referring now to FIG. 1, the sports target system 10 according to the present invention is depicted, for purposes of operational example only, as a hockey practice target system. As can be discerned from FIG. 1, the sports target system 10 includes at least one resiliently stretchable cord 12 having hooks 14 at each end thereof, and further includes one or more flaccidly flexible targets 16 which are connected with the resiliently stretchable cord. The hooks 14 provide an engagement member for hooking onto a selected location of a backdrop 22, preferably the right and left sides thereof. The backdrop 22 can be simple or complex; an example of a simple backdrop is a pair of mutually spaced apart vertical posts, while an example of a complex backdrop is a hockey goal having a frame 18 and a net 20, as shown in FIG. 1.

The resiliently stretchable cord 12 is composed of an elastomer material which is preferably covered by a synthetic fabric skin that allows for stretching. Further, the hooks 14 are preferred to be constructed of plastic coated metal and connected to each end of the resiliently stretchable cord via a spiral wound portion thereof in either a compressional or an abutting engagement therewith. An example of an acceptable resiliently stretchable cord 12 and hooks 14 is a conventional stretch cord (sometimes called a bungee cord) of the kind used commonly to tie down objects, such as an automobile trunk lid when the lid cannot be fully closed due to oversized cargo. By way of example only, a suitable conventional stretch cord for use with the present invention is manufactured by USA Products of Lodi, Calif.

The targets 16 are constructed of a flaccidly flexible sheet material so that when struck by a sports object, such as a hockey puck, baseball, golf bail, etc., the target yields flaccidly upon impact to thereby signal the impact to observers. The targets 16 are provided, at a top end 16*a* thereof, with one or more loops, preferably one continuous loop 16*b*, through which the resiliently stretchable cord 12 passes. In this respect, each target 16 is slidable along the resiliently stretchable cord 12 in that the loop 16*b* permits relative slidable movement. An example of a suitable material for the targets 16 is cloth, and the loops are provided by a sewed seam 25. The targets 16 may be colored and/or may carry indicia, such as a particular team's logo (which may serve to add some "fighting spirit" to the players' practice sessions).

In operation, a user selects a suitable backdrop which has relation to the type of sport to be practiced. Generally, a preferred structure of a backdrop is one having a frame which supports a spanning net, such as the goal shown in FIG. 1, wherein the exact configuration of the backdrop is appropriate for the type of sport activity being practiced, such as baseball pitching, golf ball striking, hockey puck hitting, etc. Next, the user, if he or she has not already done so, places the targets onto the resiliently stretchable cords. The user then hookably engages the hooks onto the left and right sides of the backdrop, such as by hooking onto the frame and/or the net thereof, so that the resiliently stretchable cords are tautly strung across the backdrop (there being minimal droop at the center). The resiliently stretchable cords may or may not be horizontal, but horizontal is preferred so that the targets hang down therefrom in a fully unfurled manner. The location of the hooking engagement provides a height of the resiliently stretchable cords that is selected by the user. Finally, the user selects the placement of the targets relative to the backdrop by sliding the one or more targets along each resiliently stretchable cord. As shown by way of example in FIG. 1, two resiliently stretchable cords are placed upon the frame of the hockey goal and the two targets carried by each are positioned to simulate the locations of the most likely open spot opportunities that are reasonably expected to occur during goal tending.

Figure 4B:
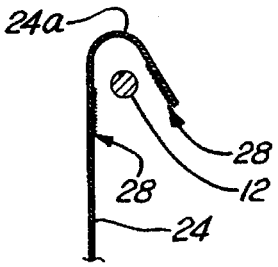
FIG. 4B is a sectional view similar to that of FIG. 4A, wherein the releasable fastener is in an open configuration.
Figure 4A:
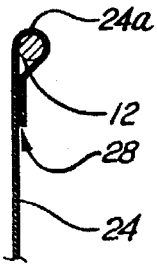
FIG. 4A is a sectional view along line 4—4 in FIG. 1.

As depicted in FIGS. 1 and 4, it is further preferred to include one or more selectively removable targets 24. In this regard the selectively removable target 24 is composed of a flaccidly flexible sheet material, such as cloth, which may be colored and/or may have printed thereon indicia. A selectively openable loop 26 is provided at the top end 24*a* thereof. In this regard, the selectively openable loop 26 is selectively openable or closable by operation of a releasable fastener 28, such as for example a button and button hole, a snap fastener, or a hook and loop fastener (as shown in FIG. 4). In operation, after the resiliently stretchable cord 12 is strung, the selectively removable target is installed thereto and positioned by slidable movement therealong or removed therefrom as desired by operation of the releasable fastener. In this regard, for example, with respect to hockey, the selectively removable target can simulate a puck target location situated between the legs of a goalie.

From the foregoing, it is to be understood that the sports target according to the present invention is portable and easily installed and modified to provide selected target locations for sports objects to thereby facilitate the productiveness of players' practice sessions.

To those skilled in the art to which this invention appertains, the above described preferred embodiment may be subject to change or modification. For example, the size and/or shape of the targets is user selectable based upon the sport and the nature of the practice. Such change or modification can be carried out without departing from the scope of the invention, which is intended to be limited only by the scope of the appended claims.

What is claimed is:

1. A sports target system comprising:

a backdrop having a left side and a right side;

a resiliently stretchable cord having a first end and an opposite second end;

a first hook connected with said first end of said resiliently stretchable cord;

a second hook connected with said second end of said resiliently stretchable cord; at least one first target, each first target comprising:

a first flaccidly flexible sheet material having a top end; and first loop means connected with said top end of said first flaccidly flexible sheet material for slidably receiving therein said resiliently stretchable cord to thereby connect said first target to said resiliently stretchable cord;

wherein said left and right hooks are hookably engaged with respect to said backdrop to thereby position said resiliently stretchable cord at a selected location with respect to backdrop, and said at least one first target is independently slid along said resiliently stretchable cord to thereby define at least one target for sports practice;

wherein said first flaccidly flexible sheet material hangs downwardly from said resiliently stretchable cord.

2. The sports target system of claim 1, wherein said first loop means is integrally connected with said first flaccidly flexible sheet material of each said first target.

3. The sports target system of claim 2, wherein at least two resiliently stretchable cords are provided, said resiliently stretchable cords being mutually spaced vertically with respect to said backdrop; and further wherein at least two said first targets are connected with each said resiliently flexible cord, said first targets being mutually spaced horizontally with respect to said backdrop.

4. The sports target system of claim 3, wherein said right hook of each said resiliently stretchable cord is hookably engaged with said right side of said backdrop and said left hook of each said resiliently stretchable cord is hookably engaged with said left side of said backdrop to thereby tautly string each said resiliently stretchable cord across said backdrop.

5. The sports target system of claim 2, further comprising at least one selectively releasable second target, said selectively releasable second target comprising:

a second flaccidly flexible sheet material having a top end;

second loop means connected with said top end of said second flaccidly flexible sheet material for slidably receiving therein said resiliently stretchable cord to thereby connect said second target to said resiliently stretchable cord; and releasable fastener means connected with said second loop means for providing selective opening and closing of said second loop means.

6. The sports target system of claim 5, wherein said second loop means is integrally connected with said second flaccidly flexible sheet material.

7. The sports target system of claim 6, wherein said right hook is hookably engaged with said right side of said backdrop and said left hook is hookably engaged with said left side of said backdrop to thereby tautly string said resiliently stretchable cord across said backdrop.

8. The sports target system of claim 6, wherein at least two resiliently stretchable cords are provided, said resiliently stretchable cords being mutually spaced vertically with respect to said backdrop; and further wherein at least two said first targets are connected with each said resiliently flexible cord, said first targets being mutually spaced horizontally with respect to said backdrop.

9. The sports target system of claim 8, wherein said right hook of each said resiliently stretchable cord is hookably engaged with said right side of said backdrop and said left hook of each said resiliently stretchable cord is hookably engaged with said left side of said backdrop to thereby tautly string each said resiliently stretchable cord across said backdrop.

10. The sports target system of claim 9, wherein said releasable fastener means is a hook and loop fastener.

* * * * *